US007704289B2

(12) United States Patent
Arters et al.

(10) Patent No.: US 7,704,289 B2
(45) Date of Patent: Apr. 27, 2010

(54) METHOD OF OPERATING A DIRECT INJECTION SPARK-IGNITED ENGINE WITH A FUEL COMPOSITION

(75) Inventors: David C. Arters, Solon, OH (US); Mitchell M. Jackson, Chagrin Falls, OH (US); Daniel T. Daly, Solon, OH (US); Malcolm G. J. Macduff, Quarndon (GB)

(73) Assignee: The Lubrizol Corporation, Wickliffe, OH (US)

( * ) Notice: Subject to any disclaimer, the term of this patent is extended or adjusted under 35 U.S.C. 154(b) by 1150 days.

(21) Appl. No.: 11/225,283

(22) Filed: Sep. 13, 2005

(65) Prior Publication Data

US 2006/0010767 A1 Jan. 19, 2006

Related U.S. Application Data

(63) Continuation of application No. 10/096,021, filed on Mar. 12, 2002, now abandoned.

(51) Int. Cl.
*C10L 1/18* (2006.01)
*C10L 1/22* (2006.01)

(52) U.S. Cl. ..... 44/412; 44/331; 44/347; 44/415; 44/432; 44/434; 44/443

(58) Field of Classification Search ..... 44/331, 44/347, 412, 415, 432, 434, 443
See application file for complete search history.

(56) References Cited

U.S. PATENT DOCUMENTS

| | | | | |
|---|---|---|---|---|
| 5,006,130 | A | 4/1991 | Aiello et al. | |
| 5,089,029 | A * | 2/1992 | Hashimoto et al. | 44/432 |
| 5,256,165 | A | 10/1993 | Herbstman et al. | |
| 5,264,006 | A | 11/1993 | Schilowitz et al. | |
| 2002/0023383 | A1 | 2/2002 | Nelson et al. | |
| 2003/0079399 | A1 * | 5/2003 | Malfer et al. | 44/329 |

FOREIGN PATENT DOCUMENTS

| | | | |
|---|---|---|---|
| EP | 0376578 | A1 | 7/1990 |
| EP | 0448365 | A1 | 9/1991 |
| EP | 0526129 | A1 | 2/1993 |
| EP | 0647700 | A1 | 4/1995 |
| EP | 0887400 | A1 | 12/1998 |
| EP | 0905217 | A1 | 3/1999 |
| JP | 11-35952 | | 2/1999 |
| WO | 93/20170 | A1 | 10/1993 |
| WO | 98/12284 | A1 | 3/1998 |
| WO | 00/20537 | | 4/2000 |
| WO | 01/42398 | A1 | 6/2001 |
| WO | 01/42399 | A1 | 6/2001 |

OTHER PUBLICATIONS

Arters et al.; A Comparison of Gasoline direct Injection and Port Fuel Injection Vehicles; Part 1—Fuel System Deposits; 5th Annual Fuels & Lubes Asia Conference 1999, p. 4.
Macduff et al.; A Comparison of Fuel System Deposits and Lubricant Performance in Gasoline Direct Injection and Port Fuel Injection Vehicles; 2nd International Fuels Colloquim Jan. 20-21, 1999; p. 1.
Arters et al.; A Comparison of Gasoline Direct Injection and Port Fuel Injection Vehicles; Part 1—Fuel System Deposits and Vehicle Performance; SAE Paper No. 1999-01-1498, May 3-6, 1999, p. 2.
Aradi et al.; A Study of Fuel Additives for Direct Injection Gasoline (DIG) Injector Deposit Control; SAE Paper No. 2000-01-2020; p. 1.
Ohkubo et al.; Deposit Formation and Control in Direct Injection Spark Ignition Engines; 6th Annual Fuels & Lubes Asia Conference, Jan. 25-28, 2000; p. 2.
Arters et al.; The Effect on Vehicle Performance of Injector Deposits in a Direct Injection Gasoline Engine; SAE Paper No. 2000-01-2021, Jun. 19-22, 2000; p. 4.

* cited by examiner

*Primary Examiner*—Cephia D Toomer
(74) *Attorney, Agent, or Firm*—David M. Shold; Christopher D. Hilker

(57) ABSTRACT

The present invention is directed to a method to clean up or keep clean the fuel system of a direct injection spark-ignited engine by operating the engine with a fuel composition that includes a liquid fuel and a fuel additive composition. The fuel additive composition useful in the present invention has at least one nitrogen-containing dispersant and optionally a fluidizer where the dispersant has a specific lipophilic parameter and the dispersant or the dispersant and the fluidizer have a specific hydrophilic-lipophilic parameter, the dispersant provides about 0.15 to about 50 ppm by weight nitrogen in the fuel composition, and the fluidizer and/or the dispersant provide about 10 to about 10,000 ppm by weight active components in the fuel composition. The method of the present invention is effective in controlling deposits in fuel injectors and combustion chambers of a direct injection spark-ignited engine.

13 Claims, No Drawings

METHOD OF OPERATING A DIRECT INJECTION SPARK-IGNITED ENGINE WITH A FUEL COMPOSITION

This application is a continuation of U.S. patent application Ser. No. 10/096,021 filed Mar. 12, 2002, now abandoned.

BACKGROUND OF THE INVENTION

1. Field of the Invention

The present invention involves a method of operating a direct injection spark-ignited engine (DISE) using a fuel composition comprising a liquid fuel and a fuel additive composition. The method provides for the cleanliness of the fuel system of the DISE.

2. Description of the Related Art

The direct injection spark-ignited engine is a new technology that has been commercially introduced in Japan and Europe by manufacturers Mitsubishi, Nissan and Toyota. The DISE offers significant performance benefits relative to a conventional port fuel injection gasoline engine (PFIGE). The specific power output of a DISE relative to a PFIGE is increased, which results in better fuel economy and driveability in terms of throttle response and acceleration. The DISE, when coupled with current catalyst systems for reducing exhaust emissions, also meets exhaust emission standards. The overall performance of a DISE is directly related to the cleanliness of the fuel system. Consequently, methods that provide for the cleanliness of the fuel system of a DISE are very desirable and useful.

International publication WO 00/20537, Haji et al., published Apr. 13, 2000, discloses a gasoline additive comprising at least one nitrogenous compound selected from a nitrogen-containing ether compound and a polybutenylamine compound. The gasoline additive is suitable for use in a gasoline composition for direct injection gasoline engines.

International publication WO 01/42399, Aradi et al., published Jun. 14, 2001, discloses that deposits in a direct injection gasoline engine are reduced by fueling the engine with a fuel composition comprising a Mannich detergent.

A number of technical presentations involve studies done on direct injection gasoline or spark ignition engines that generically disclose nitrogen-containing compounds and polyether fluidizers as fuel additives in these engines:

1. "A Comparison of Gasoline Direct Injection and Port Fuel Injection Vehicles, Part 1: Fuel System Deposits," Arters et al., $5^{th}$ Annual Fuels & Lubes Asia Conference, 1999;

2. "A Comparison of Fuel System Deposits and Lubricant Performance in Gasoline Direct Injection and Port Fuel Injection Vehicles," Macduff et al., $2^{nd}$ International Fuels Colloquium, Jan. 20-21, 1999;

3. "A Comparison of Gasoline Direct Injection and Port Fuel Injection Vehicles; Part 1—Fuel System Deposits and Vehicle Performance," Arters et al., SAE Paper No. 1999-01-1498 presented at International Spring Fuels and Lubricants Meeting and Exposition, May 3-6, 1999;

4. "A Study of Fuel Additives for Direct Injection Gasoline (DIG) Injector Deposit Control," Aradi et al., SAE, Spec. Publ., VSP-1551, Diesel and Gasoline Performance and Additives, p 283-293;

5. "Deposit Formation and Control in Direct Injection Spark Ignition Engines," Ohkubo et al., $6^{th}$ Annual Fuels & Lubes Asia Conference, Jan. 25-28, 2000;

6. "The Effect on Vehicle Performance of Injector Deposits in a Direct Injection Gasoline Engine," Arters et al., SAE Paper No. 2000-01-2021.

Japanese Patent Publication JP 11-35952, Nippon Oil Company, published Feb. 9, 1999, discloses an alcoholic compound as a gasoline additive for in-cylinder direct injection type gasoline engines.

The method of the present invention effectively provides for the cleanliness of a fuel system of a DISE by operating the engine with a fuel composition comprising a liquid fuel and a fuel additive composition. The present invention controls deposits in fuel injectors and combustion chambers of a DISE that contributes to vehicle performance in the areas of fuel economy, driveability and exhaust emissions.

SUMMARY OF THE INVENTION

An object of the present invention is to provide for the cleanliness of the fuel system of a direct injection spark-ignited engine.

A further object of the present invention is to provide for the cleanliness of the fuel injectors and combustion chambers of a direct injection spark-ignited engine.

Additional objects and advantages of the present invention will be set forth in part in the description that follows and in part will be obvious from the description or may be learned by the practice of this invention. The objects and advantages of this invention may be realized and attained by means of the instrumentalities pointed out in the appended claims.

To achieve the foregoing objects in accordance with the invention, as described and claimed herein, the method of the present invention to clean up or keep clean a fuel system of a direct injection spark-ignited engine comprises operating the engine with a fuel composition comprising a liquid fuel; and a fuel additive composition comprising at least one nitrogen-containing dispersant; and optionally a fluidizer, wherein a molecular volume factor for the dispersant is about 50 or greater, a modified hydrophilic lipophilic balance (HLBm) value for the dispersant or for the dispersant and the fluidizer is greater than about zero, the concentration of nitrogen in the fuel composition from the dispersant is about 0.15 to about 50 ppm by weight, and the concentration of active components in the fuel composition from the dispersant or the dispersant and the fluidizer is about 10 to about 10,000 ppm by weight.

In another instance of the method of the present invention, the liquid fuel is selected from the group consisting of a hydrocarbonaceous fuel, a non-hydrocarbonaceous fuel, and mixtures thereof.

In another embodiment of the method of the present invention, the nitrogen-containing dispersant is selected from the group consisting of a polyetheramine; a Mannich reaction product of a hydrocarbyl-substituted phenol, an aldehyde, and an amine; a hydrocarbyl-substituted succinimide; a hydrocarbylamine; and mixtures thereof.

In a further embodiment of the method of the present invention, the fluidizer is a polyether represented by the formula $R^7O[CH_2CH(R^8)O]_qH$ wherein $R^7$ is a hydrocarbyl group; $R^8$ is selected from the group consisting of hydrogen, hydrocarbyl groups of 1 to 16 carbon atoms, and mixtures thereof; and q is a number from 2 to about 50.

DETAILED DESCRIPTION OF THE INVENTION

The present invention involves a method to clean up or keep clean a fuel system of a direct injection spark-ignited engine (DISE). The method achieves this cleanliness by controlling deposits in the fuel system in a dual action of cleaning up or removing deposits that have formed and keeping clean or preventing deposits from forming. Introduction of the fuel additive composition via the fuel composition into a DISE having a dirty or deposit-containing fuel system cleans up the fuel system by removing deposits that have formed. Introduction of the fuel additive composition via the fuel composition into a DISE having a clean fuel system keeps the fuel system clean by preventing deposits from forming.

The fuel system in a DISE includes as components the intake valves, fuel injectors, spark plugs, combustion chambers and exhaust valves. Cleanliness of the fuel system provided by the method of the present invention is determined by measuring the amount of deposits or a property directly related to deposits for those components that have a significant effect on vehicle performance, which include fuel injectors and combustion chambers. Cleanliness of the fuel system provided by the method of the present invention can be determined as a do no harm to vehicle performance of this DISE technology for those components for which the liquid fuel and the fuel additive composition normally have a negligible or minor effect on in terms of deposits, which include intake valves, exhaust valves and spark plugs.

Vehicle performance is determined by measuring for fuel economy, driveability and exhaust emissions. Driveability includes throttle response, as misfires or stalls, and acceleration. Exhaust emissions include levels of the regulated species hydrocarbons, carbon monoxide and nitrogen oxides. Although not now regulated, levels of particulates can be included under exhaust emissions.

The fuel composition of the present invention comprises a liquid fuel and a fuel additive composition. The fuel composition is usually prepared by adding the fuel additive composition to the liquid fuel and mixing them at ambient temperature until the resultant fuel composition is homogeneous.

The liquid fuel of the present invention can be selected from the group consisting of a hydrocarbonaceous fuel, a non-hydrocarbonaceous fuel, and mixtures thereof. Hydrocarbonaceous fuels are normally hydrocarbon petroleum distillates such as gasoline as defined by ASTM specification D4814 for a mixture of hydrocarbons having a distillation range per ASTM procedure D86 from about 60° C. at the 10% distillation point to about 205° C. at the 90% distillation point. Hydrocarbonaceous fuels can also be derived from the mineral resources of shale and coal. Non-hydrocarbonaceous materials or fuels can be oxygen-containing compounds also known as oxygenates which include alcohols, ethers, organonitro compounds and esters of fatty carboxylic acids, for example, methanol, ethanol, diethyl ether, methyl ethyl ether, methyl t-butyl ether, nitromethane, and esters from vegetable oils. The non-hydrocarbonaceous fuels can be obtained from both mineral and vegetable sources. The liquid fuel can be a mixture of two or more hydrocarbonaceous fuels, of two or more non-hydrocarbonaceous fuels, or of one or more hydrocarbonaceous fuels and one or more non-hydrocarbonaceous fuels. An example of such mixtures is the combination of gasoline and ethanol.

The fuel additive composition of the present invention comprises at least one nitrogen-containing dispersant. The nitrogen-containing dispersant can be selected from the group consisting of a polyetheramine; a Mannich reaction product of a hydrocarbyl-substituted phenol, an aldehyde, and an amine; a hydrocarbyl-substituted succinimide; a hydrocarbylamine and mixtures thereof.

The term hydrocarbyl throughout this specification and the appended claims is a univalent radical of one or more carbon atoms that is predominately hydrocarbon in nature, but can have non-hydrocarbon substituent groups and can include heteroatoms.

The polyetheramine of the present invention can be represented by the formula $R[OCH_2CH(R^1)]_nA$ wherein R is a hydrocarbyl group, $R^1$ is selected from the group consisting of hydrogen, hydrocarbyl groups of 1 to 16 carbon atoms, and mixtures thereof; n is a number from 2 to about 50; and A is selected from the group consisting of $—OCH_2CH_2CH_2NR^2R^2$ and $—NR^3R^3$ wherein each $R^2$ is independently hydrogen or hydrocarbyl; and each $R^3$ is independently hydrogen, hydrocarbyl or $—[R^4N(R^5)]_pR^6$ wherein $R^4$ is $C_2$-$C_{10}$ alkylene, $R^5$ and $R^6$ are independently hydrogen or hydrocarbyl; and p is a number from 1-7.

The polyetheramine of the present invention can be prepared by initially condensing an alcohol or alkylphenol with an alkylene oxide, mixture of alkylene oxides or with several alkylene oxides in sequential fashion in a 1:2-50 mole ratio of hydric compound to alkylene oxide to form a polyether intermediate.

The alcohol can be linear or branched from 1 to 30 carbon atoms, or in another instance from 6 to 20 carbon atoms, or alternatively from 10 to 16 carbon atoms. The alkyl group of the alkylphenol can be 1 to 30 carbon atoms, or alternatively 10 to 20 carbon atoms.

The alkylene oxide can be ethylene oxide, propylene oxide or butylene oxide. The number of alkylene oxide units in the polyether intermediate can be 10-35, or in another instance 18-27.

U.S. Pat. No. 5,094,667 provides reaction conditions for preparing a polyether intermediate, the disclosure of which is incorporated herein by reference.

The polyether intermediate can be converted to a polyetheramine by amination with ammonia, an amine or a polyamine to form a polyetheramine of the type where A is $—NR^3R^3$. European Patent EP310875 provides reaction conditions for the amination reaction, the disclosure of which is incorporated herein by reference. Polyetheramines of the type where A is $—NR^3R^3$ are commercially available as the Jeffamine® series from Huntsman. Alternately, the polyether intermediate can be converted to a polyetheramine of the type where A is $—OCH_2CH_2CH_2NH_2$ by reaction with acrylonitrile followed by hydrogenation. U.S. Pat. No. 5,094,667 provides reaction conditions for the cyanoethylation with acrylonitrile and subsequent hydrogenation, the disclosure of which is incorporated herein by reference. U.S. Pat. No. 5,830,243 discusses methods of preparing polyetheramines, the disclosure of which is incorporated herein by reference.

The Mannich reaction product of the present invention is prepared from a hydrocarbyl-substituted phenol. The hydrocarbyl substituent can have a number average molecular weight of 500 to 3000, or alternatively 700 to 2300, or in another instance 750 to 1500. The hydrocarbyl substituent is generally derived from a polyolefin. The polyolefin is generally derived from the polymerization of an olefin monomer including ethylene, propylene, various butene isomers such as isobutylene, and mixtures thereof. The hydrocarbyl-substituted phenol can be obtained by alkylating phenol with a polyolefin using an alkylation catalyst such as boron trifluoride. Polyisobutylenes can be used to alkylate phenol, and highly reactive polyisobutylene can be used in the alkylation in which at least 70% of the olefinic double bonds in the polyisobutylene are of the vinylidene type at a terminal position on the polymer chain. A commercial example of highly reactive or high vinylidene polyisobutylenes is Glissopal® marketed by BASF.

The aldehyde used to prepare the Mannich reaction product of the present invention can be a $C_1$-$C_6$ aldehyde. Formaldehyde can be used in one of its reagent forms such as paraformaldehyde and formalin.

The amine used to prepare the Mannich reaction product of the present invention can be a monoamine or a polyamine and includes organic compounds containing at least one HN< group suitable for use in the Mannich reaction. Polyamines include dimethylaminopropylamine, alkylenepolyamines such as ethylenediamine and polyalkylenepolyamines such as diethylenetriamine.

The conditions required for the Mannich reaction to form the Mannich reaction product of this invention are known in the art. For typical conditions for the Mannich reaction see U.S. Pat. Nos. 3,877,889; 5,697,988 and 5,876,468, the disclosures of which are incorporated herein by reference.

The hydrocarbyl group of the hydrocarbyl-substituted succinimide of the present invention can be derived from a polyolefin having a number average molecular weight of 500 to 5,000, or in another instance 700 to 2,300 or alternatively 750 to 1,500. The polyolefin is generally derived as described above for the Mannich reaction product from polymerization of olefin monomers such as polyisobutylene from polymerized isobutylene. The polyisobutylene can be the highly reactive type having at least 70% of its olefinic double bonds as the vinylidene type. The hydrocarbyl-substituted succinimide is usually prepared by reacting a hydrocarbyl-substituted succinic acylating agent with an amine having a —$NH_2$ group. The amine can be a polyamine to include alkylenepolyamines such as ethylenediamine and polyalkylenepolyamines such as tetraethylenepentamine and polyethylenepolyamine bottoms. U.S. Pat. Nos. 4,234,435 and 5,719,108 provide descriptions of methods to prepare hydrocarbyl-substituted succinimides, the disclosures of which are incorporated herein by reference.

The hydrocarbylamine of the present invention can be derived from a polyolefin having a number average molecular weight of 500 to 5000, or alternatively 700 to 2300, or in another instance 750 to 1500. The hydrocarbylamine can be prepared by chlorinating a polyolefin and then reacting the chlorinated polyolefin with an amine or an alkanolamine in the presence of a base such as sodium carbonate or sodium hydroxide. The polyolefin can be polyisobutylene. The amine can be a polyamine to include alkylenepolyamines such as ethylenediamine and polyalkylenepolyamines such as diethylenetriamine. The alkanolamine can be a polyamine such as aminoethylethanolamine. U.S. Pat. No. 5,407,453 describes a method to prepare hydrocarbylamines, the disclosure of which is incorporated herein by reference.

The fuel additive composition of the present invention comprises optionally a fluidizer. The fluidizer can be a polyether represented by the formula $R^7O[CH_2CH(R^8)O]_qH$ wherein $R^7$ is a hydrocarbyl group; $R^8$ is selected from the group consisting of hydrogen, hydrocarbyl groups of 1 to 16 carbon atoms, and mixtures thereof; and q is a number from 2 to about 50. Embodiments and a method of preparation for the polyether were presented above in the description of the polyetheramine under the description of the polyether intermediate. A commercial example of the polyether is the Bayer Actaclear® series. Commercial samples are also available from Dow Chemical Co., Huntsman, and ICI.

The method of the present invention comprises operating a direct injection spark-ignited engine with a fuel composition that comprises a liquid fuel and a fuel additive composition comprising at least one nitrogen-containing dispersant and optionally a fluidizer wherein, as described herein, a molecular volume factor for the dispersant is about 50 or greater, a modified hydrophilic lipophilic balance (HLBm) value for the dispersant or for the dispersant and fluidizer is greater than about zero, the concentration of nitrogen in the fuel composition from the dispersant is about 0.15 to about 50 ppm by weight, and the concentration of active components in the fuel composition from the dispersant or the dispersant and the fluidizer is about 10 to about 10,000 ppm by weight. The concentration of the dispersant or the dispersant and fluidizer given in ppm by weight throughout this application, unless indicated otherwise, is based on active components and does not include diluents such as hydrocarbon solvents.

In another embodiment of the method of the present invention, the HLBm value for the dispersant or for the dispersant and the fluidizer is greater than about 50, the concentration of nitrogen in the fuel composition from the dispersant is about 0.20 to about 25 ppm by weight, and the concentration of the active components in the fuel composition from the dispersant or the dispersant and the fluidizer is about 20 to about 4,000 ppm by weight.

In a further embodiment of the method of the present invention, the HLBm value for the dispersant or for the dispersant and the fluidizer is greater than about 100, the concentration of nitrogen in the fuel composition from the dispersant is about 0.25 to about 15 ppm by weight, and the concentration of the active components in the fuel composition from the dispersant or the dispersant and the fluidizer is about 30 to about 3,200 ppm by weight.

To practice the method of the present invention, the fuel composition needs to simultaneously satisfy four requirements which are a minimum molecular volume factor, a modified hydrophilic lipophilic balance value, a nitrogen concentration and an active components concentration for the dispersant or for the dispersant and the fluidizer as indicated in the embodiments of the invention described above. In turn the fuel additive composition needs to be formulated so that these four requirements are met. The fuel additive composition can be formulated to meet these requirements by selecting at least one nitrogen-containing dispersant, and optionally a fluidizer such as a polyether. The nitrogen-containing dispersant can be selected from the group consisting of a polyetheramine, a Mannich reaction product, a succinimide, a hydrocarbylamine, and mixtures thereof. Examples of formulations for the fuel additive composition capable of meeting the above described requirements are the following: a polyetheramine and optionally a fluidizer, a Mannich reaction product and optionally a fluidizer, a succinimide and optionally a fluidizer, a hydrocarbylamine and optionally a fluidizer, a polyetheramine and a Mannich reaction product and optionally a fluidizer, a polyetheramine and a succinimide and optionally a fluidizer, a polyetheramine and a hydrocarbylamine and optionally a fluidizer, a Mannich reaction product and a succinimide and optionally a fluidizer, a Mannich reaction product and a hydrocarbylamine and optionally a fluidizer, and a succinimide and a hydrocarbylamine and optionally a fluidizer. Formulations for the fuel additive composition capable of meeting the four requirements are also possible by selecting combinations of three or four members from the nitrogen-containing dispersant group consisting of a polyetheramine, a Mannich reaction product, a succinimide, and a hydrocarbylamine, and optionally a fluidizer such as a polyether.

The four requirements regarding the fuel additive composition in the fuel composition of molecular volume factor, modified hydrophilic lipophilic balance value, nitrogen concentration and active components concentration correspond with the dispersant or the dispersant and fluidizer being soluble in the liquid fuel and effective in controlling deposits in the fuel system. Hydrophilic lipophilic balance (HLB) values can be calculated as a function of molecular volume and water of solvation as described by John C. McGowan in "A New Approach for the Calculation of HLB Values of Surfactants," Tenside Surf. Det. 27 (1990) 4, pp. 229-230 via the formula HLB=7−(0.337)($10^5$)(Vx)+(1.5)(n). HLB values calculated by this method were found to have a statistically significant correlation with combined combustion chamber and fuel injector deposit performance in a direct injection spark-ignited engine, however, modified hydrophilic lipophilic balance values were found to have superior correlation with the combined deposit performance as demonstrated in the examples herein below. The HLBm values can be calculated by a modification, which emphasizes the hydrophilic property, of the formula used to calculate HLB values which is $$HLBm=7-(0.337)(10^5)(Vx)+(7.5)(n).$$

The molecular volume factor ($10^5$)(Vx) for a dispersant or fluidizer molecule is related to the lipophilic nature of that molecule and directly related to its molecular weight. The molecular volume factor for a given molecule can be determined by first multiplying an atomic volume value by the total number of atoms for each atomic element present in the molecule to give products which are total atomic volumes, second summing these total atomic volumes, and lastly subtracting from this summation an adjustment due to bonding which is the product of (0.656)(total number of bonds in the molecule) where all bonds including double and triple bonds are counted as single bonds. The atomic volume values for atoms in this application are as follows: 0.871 for H, 1.635 for C, 1.243 for O and 1.439 for N.

The water of solvation factor n is the number of water molecules that can be involved in solvation of a dispersant or fluidizer molecule and is related to the hydrophilic nature of that molecule. Water of solvation values for heteroatom types in this application are as follows: 1 for oxygen and 1 for nitrogen except that a primary amine nitrogen such as the nitrogen in methylamine has a value of 2. The water of solvation factor for a given molecule is obtained by summing the products of (water of solvation value for a heteroatom type) times (total number of a heteroatom type in the molecule) for each heteroatom type present in the molecule.

The modified HLB value for a given dispersant or fluidizer molecule is then determined by entering the calculated values for the molecular volume factor ($10^5$)(Vx) and the water of solvation factor n into the formula HLBm=7−(0.337)($10^5$)(Vx)+(7.5)(n).

When there are 2 or more dispersant or dispersant and fluidizer molecules present in the fuel additive composition, the HLBm value for their combination is determined by first calculating the HLBm value for each different molecule as described above. The HLBm value for their combination is then determined by summing the products of the weight fraction and the HLBm value for each different dispersant and fluidizer molecule present. The weight fraction for a dispersant or fluidizer molecule can be determined from the ratio of the weight of that molecule to the total weight of all the dispersant and fluidizer molecules present in the fuel additive composition.

Illustrative of the method to calculate modified HLB values, the calculation of the HLBm value for ethanol is outlined as follows. The molecular volume factor for ethanol having 6-Hs, 2-Cs, 1-O and 8 bonds is 4.491. The water of solvation factor for ethanol with one oxygen heteroatom is 1. The HLBm value for ethanol is [7−(0.337)(4.491)+(7.5)(1)] or 13.

The embodiments of the present invention provide ppm weight ranges for the concentration of nitrogen and for the concentration of active components in the fuel composition from the dispersant or the dispersant and fluidizer that provide for effective control of deposits in the fuel system by the method of the present invention whether the fuel composition is the result of additive treatment of the liquid fuel at a fuel terminal or an aftermarket additive treatment.

The fuel composition and fuel additive composition of the present invention can contain a hydrocarbon solvent to provide for compatibility or homogeneity and in the fuel additive composition to facilitate handling and transfer. The hydrocarbon solvent concentration in the fuel additive composition can be 10-80% by weight, alternatively 20-70% by weight, and in another instance 30-60% by weight. The hydrocarbon solvent can be an aliphatic fraction, aromatic fraction, or mixture of aliphatic and aromatic fractions where the flash point is generally about 40° C. or higher. The hydrocarbon solvent is typically an aromatic naphtha having a flash point above 62° C. or an aromatic naphtha having a flash point of 40° C. or a kerosene with a 16% aromatic content having a flash point above 62° C.

The fuel additive composition and fuel composition of the present invention can contain other additives that are well known to those of skill in the art. These can include anti-knock agents such as tetra-alkyl lead compounds and MMT (methylcyclopentadienyl manganese tricarbonyl), lead scavengers such as halo-alkanes, dyes, antioxidants such as hindered phenols, rust inhibitors such as alkylated succinic acids and anhydrides and derivatives thereof, bacteriostatic agents, auxiliary dispersants and detergents, gum inhibitors, fluidizer oils, metal deactivators, demulsifiers, anti-valve seat recession additives such as alkali metal sulphosuccinate salts, and anti-icing agents. The fuel composition of this invention can be a lead-containing or lead-free fuel, typically a lead-free fuel.

The following examples are illustrative of the method of the present invention to clean up or keep clean the fuel system of a direct injection spark-ignited engine by controlling deposits, but are not limiting on the scope of the invention as defined by the appended claims.

Examples 1-16 demonstrate the effectiveness of the method of the present invention in controlling deposits in the combustion chambers and fuel injectors of a direct injection spark-ignited engine in real world, vehicle tests. This controlling of deposits in the combustion chambers and fuel injectors is directly correlated to vehicle performance. Excellent control of one deposit type does not insure control of the other. The present invention provides a method to optimize performance for both injector and combustion chamber deposits in DISE engines. The greater the HLBm value for the nitrogen-containing dispersant and fluidizer when present, the greater the assurance that both injector and combustion chamber deposit control will be achieved provided the other three requirements of molecular volume factor, nitrogen concentration and actives concentration are met.

TABLE I

| Vehicle Keep Clean Field Test[1] | | | | |
|---|---|---|---|---|
| Example | Fuel Treated | HLBm | Average CCD[3] | Avg Inj Flow Loss[4] |
| 1 | No | — | 9.2 | 3.2% |
| 2 | PIBEDA/PE-1[2] | 71 | 8.8 | −0.1% |

[1]Field Test procedure: 1998, 1.8 liter direct injection gasoline engine-equipped vehicle of German emissions certification calibration; 20,100 km over controlled track drive cycle. Drive cycle emphasizing combustion chamber deposit discrimination over injector deposit discrimination.

[2]Base fuel from Example 1 treated with additive composition that included a hydrocarbylamine (HLBm −14) prepared from 1,300 molecular weight polyisobutylene and ethylenediamine and a polyether (HLBm 149.5) prepared from a $C_{12-15}$ alcohol that was propoxylated with 22-26 units of propylene oxide.The ratio of hydrocarbylamine to polyether was 1:1.07 by weight on an actives basis. The concentration of hydrocarbylamine in the treated fuel was 3.1 ppm by weight of nitrogen, and the concentration of hydrocarbylamine and polyether in the treated fuel was 425 ppm by weight on an actives basis.

[3]Sum of average piston top and cylinder head deposit thickness via multi-point measurement, in mil (0.001 inch)/cylinder. A direct correlation was observed between combustion chamber deposits (CCD) and time required to accelerate from a standing start to 100 km/hr of the DISE vehicle.

[4]Injector deposit levels indicated by percent flow loss between start-of-test (SOT) and end-of-test (EOT) of the mileage accumulation. There is a direct correlation of vehicle performance in terms of fuel economy, exhaust emissions and driveability with the control of deposit formation in the fuel injectors.Measured as the change in average mass of Stoddard solvent flow through the four injectors over a 10 sec time interval at 510 kPa;

Average Flow Loss (%) = $(\Sigma_{n=1,4}[\text{Flow}_{SOT} - \text{Flow}_{EOT}]/\text{Flow}_{SOT})/4 * 100$.

TABLE II

| Vehicle Keep Clean Field Test[1] | | | | |
|---|---|---|---|---|
| Example | Fuel Treated | HLBm | Average CCD[4] | Avg Inj Flow Loss[5] |
| 3 | No | — | 16.0 | 2.9% |
| 4 | Mannich/PE-2[2] | 48 | 16.6 | 1.3% |
| 5 | PEA[3] | 129 | 13.8 | 1.0% |

[1]Field Test procedure: 1998, 1.8 liter direct injection gasoline engine-equipped vehicle of German emissions certification calibration; 20,100 km over controlled track drive cycle. Drive cycle emphasizing combustion chamber deposit discrimination over injector deposit discrimination.

[2]Base fuel from Example 3 treated with an additive composition that included a Mannich reaction product (HLBm −2) prepared from phenol alkylated with 1,000 molecular weight polyisobutylene, formaldehyde, and ethylenediamine and a polyether(HLBm 71) prepared from dodecylphenol propoxylated with 11 units of propylene oxide. Ratio of Mannich to polyether was 1:2.15 by weight on an actives basis. The concentration in the treated fuel was 1.9 ppm by weight of nitrogen and was 335 ppm by weight on an actives basis.

[3]Base fuel from Example 3 treated with an additive composition that included a polyetheramine (HLBm 129) prepared from a $C_{13}$ alcohol that was butoxylated with 20 units of 1,2-butylene oxide, cyanoethylated with acrylonitrile and finally hydrogenated to the amine.The concentration in the treated fuel was 1.2 ppm by weight of nitrogen and was 180 ppm by weight on an actives basis.

[4]Sum of average piston top and cylinder head deposit thickness per Table I.

[5]Injector percent flow loss between start and end of mileage accumulation test per Table I.

TABLE III

| Vehicle Keep Clean Field Test[1] | | | |
|---|---|---|---|
| Example | Fuel Treated | HLBm | Average CCD[4] |
| 6 | No | — | 0.94 |
| 7 | Mannich/PE-2[2] | 48 | 0.95 |
| 8 | PIBEDA/Oil[3] | −7 | 1.41 |

[1]Road Test: 1998, 1.8 liter direct injection gasoline engine-equipped vehicle of UK emissions certification calibration; 3840 km over controlled road drive cycle of mixed urban, suburban and highway accumulation.

[2]Fuel treated with additive composition that included a Mannich reaction product and a polyether of composition and ratio as described in Example 4. The concentration in the treated fuelwas 1.4 ppm by weight of nitrogen and was 255 ppm by weight on an actives basis.

[3]Fuel treated with additive composition that included a hydrocarbylamine (HLBm −14) prepared from 1,300 molecular weight polyisobutylene and ethylenediamine and a 600 N mineral oil (estimated average $C_{22}$ paraffinic hydrocarbon; HLBm −3).The ratio of hydrocarbylamine to mineral oil was 1:2.0 by weight on an actives basis. The concentration in the treated fuel was 3.0 ppm by weight of nitrogen and was 600 ppm by weight on an actives basis

[4]Sum of average piston top and cylinder head deposit mass via scraping and collection of deposits, in gram/cylinder.

TABLE IV

| Vehicle Fuel Injector Deposit Keep Clean Tests[1] | | | | |
|---|---|---|---|---|
| Example | Fuel Treated | HLBm | Avg. Flow Loss[4] | Max Flow Loss[5] |
| 9 | No | — | 17.9% | 33.4% |
| 10 | Mannich/PE-2[2] | 48 | 3.4% | 11.3% |
| 11 | Mannich/PE-1[3] | 81 | 4.2% | 6.9% |

[1]Fuel Injector Deposit Keep Clean Test: 1998, 1.8 liter direct injection gasoline engine; run 16,000 km per procedure of ASTM D 5598 port fuel injector fouling test mileage accumulation procedure to emphasize injector deposit discrimination.Injectors were flow tested at start-of-test (SOT) and end-of-test (EOT) but the engine was not disassembled.

[2]Base fuel of Example 9 treated with additive that included a Mannich reaction product and a polyether of composition and ratio as described in Example 4. The concentration in the treated fuel was 1.9 ppm by weight of nitrogen and was335 ppm by weight on an actives basis

[3]Base fuel of Example 9 treated with additive composition that included a Mannich reaction product (HLBm −2) as described in Example 4 and a polyether (HLBm 149.5) as described in Example 2. Ratio of Mannich to polyetherwas 1:1.2 by weight on an actives basis. The concentration in the treated fuel was 2.6 ppm by weight of nitrogen and was 335 ppm by weight on an actives basis.

[4]Average Injector flow loss as described in Table 1.

[5]Flow loss calculated for the single injector with the greatest percent fouling.

TABLE V

Vehicle Fuel Injector Deposit Clean Up Tests[1]

| Example | Fuel Treated | HLBm | Test Duration | Avg. Clean Up[5] | Rate of Clean Up |
|---|---|---|---|---|---|
| 12 | Mannich/PE-1[2] | 81 | 8,000 km | 4.9% | $0.61 \times 10^{-3}$%/km |
| 13 | PEA[3] | 129 | 5,000 km | 3.5% | $0.70 \times 10^{-3}$%/km |
| 14 | Succinimide/Oil[4] | 16 | 5,000 km | 4.3% | $0.86 \times 10^{-3}$%/km |

[1]Fuel Injector Deposit Clean Up Test: 1998, 1.8 liter direct injection gasoline engine; run 8,000 km per procedure of ASTM D 5598 port fuel injector fouling test mileage accumulation procedure to emphasize injector deposit discrimination. Examples 12-14 involved consecutive cleanup runs on avehicle having fuel injector deposits that were formed from an initial 16,000 km run on untreated fuel.Injectors were flow tested at start-of-test (SOT) and end-of-test (EOT) but the engine was not disassembled. Example 12 was run for 8,000 km followed by Example 13 for 5,000 km and finally Example 14 for 5,000 km.
[2]Base fuel of Example 9 treated with additive that included a Mannich reaction product and a polyether of composition, ratio and dose as described in Example 11.
[3]Base fuel of Example 9 treated with additive that included a polyetheramine of composition as described in Example 5. The concentration in the treated fuel was 2.2 ppm by weight of nitrogen and was 335 ppm by weight on an actives basis.
[4]Base fuel of Example 9 treated with additive composition that included a succinimide (HLBm 26) prepared from 1,000 molecular weight polyisobutylene and tetraethylenepentamine, and a 600 N mineral oil (HLBm −3). The ratio of succinimide to mineral oil was 1:0.5 by weight on an actives basis.The concentration in the treated fuel was 3.8 ppm by weight of nitrogen and was 160 ppm by weight on an actives basis.
[5]Average injector clean up calculated as reduction in flow loss from end of test (EOT) compared to start of test (SOT);
Avg Clean Up = $[(\text{Avg Flow Loss})_{SOT} - (\text{Avg Flow Loss})_{EOT}/(\text{Avg Flow Loss})_{SOT}](100)$.

TABLE VI

Vehicle CCD Clean Up Field Test

| Example | Fuel Treated | HLBm | Avg CCD Thickness SOT | Avg CCD Thickness EOT | CCD Clean Up[3] |
|---|---|---|---|---|---|
| 15[1] | PEA | 129 | 16.6 | 8.8 | 47% |
| 16[2] | Mannich/PE-1 | 81 | 19.1 | 16.7 | 12% |

[1]A vehicle that had run for 20,100 km in Example 4 was reassembled with deposits intact. The vehicle run for an additional 1,100 km using the same fuel described in Example 4 but with the addition of the polyetheramine (PEA) from Example 5 at an order of magnitude increased treatment level; that is, an aftermarket treatment level. The concentration of PEA in the treated fuel was 21 ppm by weight of nitrogen and was 3200 ppm by weight on an actives basis. It was also found that intake valve deposits, which are not directly impacted by additive in DISE engines under normal dosages/operating modes, were reduced by 23% by this treatment.
[2]A vehicle that had run for 34,000 km in Examples 9 and 12-14 was disassembled, combustion chamber deposits measured, and reassembled with deposits intact. The vehicle run for an additional 1,300 km using the base fuel of Example 9 but with the addition of the Mannich and polyether additive compositionfrom Example 11 at an order of magnitude increased treatment level; that is, an aftermarket treatment level. The concentration in the treated fuel was 24 ppm by weight of nitrogen and was 3200 ppm by weight on an actives basis. Intake valve deposits were also reduced, by 28%, by this treatment.
[3]CCD Clean Up determined from the measured difference (reduction or clean up) for each of the four cylinders of the deposit thickness at the start of test (SOT) compared to the deposit thickness upon completion of the additional mileage (EOT);
Average CCD Clean Up (%) = $(\Sigma_{n=1,4}[CCD_{SOT} - CCD_{EOT}]/CCD_{SOT})/4 * 100$.

What is claimed is:

1. A method to clean up or keep clean a fuel system of a direct injection spark-ignited engine, comprising: operating the engine with a fuel composition comprising a liquid fuel; and a fuel additive composition comprising at least one nitrogen-containing dispersant; and optionally a polyether fluidizer, wherein a molecular volume factor for the dispersant is about 50 or greater, a modified hydrophilic lipophilic balance (HLBm) value for the dispersant or for the dispersant and the fluidizer is greater than 50, the concentration of nitrogen in the fuel composition from the dispersant is about 0.15 to about 50 ppm by weight, and the concentration of active components in the fuel composition from the dispersant or the dispersant and the fluidizer is about 10 to about 10,000 ppm by weight.

2. The method of claim 1, wherein the liquid fuel is selected from the group consisting of a hydrocarbonaceous fuel, a non-hydrocarbonaceous fuel, and mixtures thereof.

3. The method of claim 2, wherein the liquid fuel is selected from the group consisting of gasoline, ethanol, and mixtures thereof.

4. The method of claim 1, wherein the concentration of the nitrogen is about 0.20 to about 25 ppm by weight, and the concentration of the active components is about 20 to about 4,000 ppm by weight.

5. The method of claim 1, wherein the HLBm value is greater than about 100, the concentration of the nitrogen is about 0.25 to about 15 ppm by weight, and the concentration of the active components is about 30 to about 3,200 ppm by weight.

6. The method of claim 1, wherein the nitrogen-containing dispersant is selected from the group consisting of a Mannich reaction product of a hydrocarbyl-substituted phenol, an aldehyde, and an amine; a hydrocarbyl-substituted succinimide; a hydrocarbylamine; and mixtures thereof; and wherein the optional polyether fluidizer is present and wherein the concentration of active components in the fuel composition from the dispersant and the fluidizer is from 10 to 10,000 ppm by weight.

7. The method of claim 6, wherein the hydrocarbyl substituent of the phenol of the Mannich reaction product is derived from a polyisobutylene having a number average molecular weight of from 500 to 3,000.

8. The method of claim 7, wherein the polyisobutylene has a vinylidene isomer content of at least 70%; and the amine of the Mannich reaction product is ethylenediamine.

9. The method of claim 6, wherein the succinimide is prepared from a hydrocarbyl-substituted succinic acylating agent; and a polyamine wherein the hydrocarbyl substituent is derived from a polyisobutylene having a number average molecular weight of from 500 to 5,000.

10. The method of claim 6, wherein the hydrocarbylamine is prepared from a chlorinated polyisobutylene; and a polyamine wherein the polyisobutylene has a number average molecular weight of from 500 to 5,000.

11. The method of claim 1, wherein the fluidizer is a polyether represented by the formula $R^7O[CH_2CH(R^8)O]_qH$ wherein $R^7$ is a hydrocarbyl group; $R^8$ is selected from the group consisting of hydrogen, hydrocarbyl groups of 1 to 16 carbon atoms, and mixtures thereof; and q is a number from 2 to about 50.

12. The method of claim 11, wherein $R^7$ is a $C_1$-$C_{30}$ alkyl group or a $C_1$-$C_{30}$ alkyl-substituted phenyl group; $R^8$ is hydrogen, methyl or ethyl; and q is a number from about 10 to about 35.

13. The method of claim 1 wherein the nitrogen-containing dispersant is a polyetheramine and optionally an additional dispersant additive selected from the group consisting of a Mannich reaction product of a hydrocarbyl-substituted phenol, an aldehyde, and an amine; a hydrocarbyl-substituted succinimide; a hydrocarbylamine; and mixtures thereof.

* * * * *